US006771022B1

(12) United States Patent
Lee

(10) Patent No.: US 6,771,022 B1
(45) Date of Patent: Aug. 3, 2004

(54) BACKPLATE FOR A PLASMA DISPLAY PANEL AND METHOD FOR FABRICATING THEREOF

(75) Inventor: Yoon Kwan Lee, Kwangmyoung (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/531,759

(22) Filed: Mar. 20, 2000

(30) Foreign Application Priority Data

Mar. 2, 1999 (KR) ..... 1999/9554
Apr. 30, 1999 (KR) ..... 1999/15716

(51) Int. Cl.[7] ..... H01J 17/49
(52) U.S. Cl. ..... 313/582; 313/586; 313/587; 430/312; 430/321
(58) Field of Search ..... 313/489, 582, 313/586, 587, 493, 634; 430/312, 321; 445/24, 25, 14

(56) References Cited

U.S. PATENT DOCUMENTS 5,951,350 A * 9/1999 Aoki et al. ..... 445/24
5,957,743 A * 9/1999 Konishi et al. ..... 313/587
5,992,320 A * 11/1999 Kosaka et al. ..... 313/582
6,008,582 A * 12/1999 Asano et al. ..... 313/582
6,039,619 A * 3/2000 Kang et al. ..... 445/24
6,482,062 B1 * 11/2002 Yao et al. ..... 313/582

FOREIGN PATENT DOCUMENTS

JP 04-075231 3/1992 ..... H01J/9/22
JP 09-161677 6/1997
JP 09-199029 7/1997
JP 09-288974 11/1997 ..... H01J/9/227
JP 10-003859 1/1998
JP 10125228 A * 5/1998 ..... H01J/9/227
JP 10-228863 8/1998
JP 11-025867 1/1999
JP 11-040065 2/1999
JP 11-096911 4/1999
JP 2000288068 A * 10/2000 ..... A61J/1/05

OTHER PUBLICATIONS

Japanese Office Action dated Mar. 4, 2003.*

* cited by examiner

*Primary Examiner*—Nimeshkumar D. Patel
*Assistant Examiner*—Mariceli Santiago
(74) *Attorney, Agent, or Firm*—Fleshner & Kim, LLP

(57) ABSTRACT

The present invention relates to a backplate for a PDP and a fabrication method of the same capable of uniformly coating the phosphor material in the inner portion of the discharge cell of the PDP based on the height of the barrier rib(the backplate and the space surrounded by the barrier ribs). In one embodiment of the present invention, the lubricant material may be coated on the substrate having the barrier ribs, and then the lubricant thin film is formed, and then the phosphor material is coated on the lubricant thin film. In another embodiment of the present invention, the phosphor material is coated on the substrate having the barrier ribs, and then a certain compression gas is sprayed so that the phosphor material is uniformly coated on the barrier ribs and on the bottom portion of the backplate in which the barrier ribs are installed, whereby it is possible to uniformly coat the phosphor material at a certain thickness irrespective of the height of the barrier ribs.

17 Claims, 12 Drawing Sheets

BACKPLATE FOR A PLASMA DISPLAY PANEL AND METHOD FOR FABRICATING THEREOF

BACKGROUND OF THE INVENTION

1. Field of the Invention

The present invention relates to a backplate for a Plasma Display Panel (PDP) and a method for fabricating thereof, and in particular to a backplate for a PDP and a fabrication method thereof which are capable of uniformly coating a phosphor material on an inner portion (a region of a backplate and a region surrounded by the barrier ribs) of a discharge cell of a PDP based on the height of a barrier rib.

2. Description of the Background Art

Recently, since the structure of a Plasma display Panel (PDP) is simple as a flat type display unit and there is not limit in the size of the display, the PDP will receive a big attention as a key display unit in the flat display market. In the PDP, ultraviolet rays generated during a plasma discharge by He—Ne or Ne—Xe gas in discharge cells separated by the barrier ribs excite Red, Green and Blue phosphor materials formed on the barrier ribs, so that a visual ray is generated when the excited phosphor material is transited to a base state. Therefore, a certain character or graphic is displayed by the thusly emitted visual rays using the above-described visual ray discharge principle.

FIG. 1 is a view illustrating the structure of an AC-PDP and one cell in a conventional AC-PDP which includes a front glass substrate 1 for displaying an age, a backplate 23 installed parallel with the front glass substrate 1 and distanced from the front glass substrate 1 by a certain distance, and a plurality of barrier ribs 13 formed between the front glass substrate 10 and the backplate 12 a certain distance therebetween for forming a discharge region in the interior of a discharge cell for preventing an electrical/optical interference between the cells.

Here, the front glass substrate 1 includes an upper dielectric layer 3 for cumulating a barrier wall electric charge, sustaining a discharge sustaining voltage, protecting electrodes from an ion impact during a gas discharge and preventing diffusion of ions, and a protection film layer 9 formed on the surface of the upper dielectric layer 3, protecting the upper dielectric layer 3 from a sputtered plasma particle, extending the life span of the same, increasing the efficiency of the discharge of a relatively high secondary electron when a relatively low ion energy collides with the surface during the plasma discharge and decreasing the changes of a discharge characteristic of a fireproof metal. At this time, the protection film layer 9 is formed of MgO.

In the interior of the upper dielectric layer 3, there are a sustain electrode 5 using Indium tin Oxide (ITO) as a transparent electrode, and a bus electrode 7 formed of a metal engaged with the sustain electrode 5.

The backplate 23 includes an address electrode 19 for generating a discharge with respect to the sustain electrode 5 and the bus electrode 7, an under layer 21 for adhering the address electrode 19 and the backplate, a lower dielectric layer 17 for covering the address electrode 19, and a phosphor material 15 for covering the lower dielectric layer 17 and the barrier ribs 13 formed thereon and generating a visual ray.

A black top 11 is engaged at an upper end of the barrier rib 13 for absorbing light externally inputted through the front glass substrate 1.

In the thusly constituted PDP, in a state that a mixed gas of He—Ne and Ne—Xe is filled, a discharge is generated between the address electrode 19 and the sustain electrode 5, and when a discharge is continuously generated between the sustain electrodes 5, a vacuum ultraviolet (VUV) of 147 nm wavelength is outputted. Thereafter, the vacuum ultraviolet ray excites the phosphor material 15. When the phosphor material is transited from the excited state to the base state, a visual ray of Red, Green and Blue is discharged, so that a certain image is displayed on the front glass substrate 1.

Therefore, since the phosphor material 15 outputs light for displaying a certain image on the front glass substrate, the phosphor material 15 must be uniformly coated at the discharge cell based on a material characteristic of the phosphor material.

As a method for coating the phosphor material, there are a screen printing method, a sand blast method, a photolithography method, an electric melting method, etc. Among the above-described methods, the screen printing and sand blast methods are widely used.

FIG. 2 is a flow chart of a fabrication method of a backplate of a conventional PDP using a screen printing method. As shown therein, a screen mask is arranged on the backplate having barrier ribs. The above-described fabrication method includes a step ST11 for arranging a screen mask on the backplate for coating a red phosphor material, and a step ST12 for printing/drying the red phosphor material for thereby coating a red phosphor material. Identically to the step for coating the red phosphor, material on the backplate, the screen mask is arranged on the backplate with respect to the green and blue phosphor materials in Steps ST13 and ST15. Thereafter, the green phosphor material and blue phosphor material are printed and dried in Step ST14 and ST16. The green and blue phosphor materials are sequentially coated on each discharge cell after coating the red phosphor material.

FIGS. 3A through 3C are cross-sectional views for coating a phosphor material on the discharge cell of the conventional PDP using the screen printing method.

As shown in FIG. 3A, the screen mask 33 is positioned on the backplate 23 on which the under layer 21, the address electrode 19, the lower dielectric layer 17 and the barrier ribs 13 are sequentially formed, and the red, green or blue phosphor material 15 of the paste state is printed on the backplate 23. After printing the phosphor material, the screen mask 33 is removed, and as shown in FIG. 3B, the phosphor material 15 is coated a height similar to the height of the barrier rib 13. At this time, when drying the backplate including the coated phosphor material, as shown in FIG. 3C, an organic solvent is evaporated, and the volume of the same is decreased. Therefore, the phosphor material 15 is coated only on the surfaces of the lower dielectric layer 17 and the barrier ribs 13.

FIG. 4 is a flow chart of a backplate fabrication method of a conventional PDP using the sand blast method. As shown therein, the method includes Steps ST21, ST23 and ST25 for printing and drying the red, green and blue phosphor materials on the front surface of the backplate 23 having the barrier ribs, Steps ST22, ST24 and ST26 for light-exposing and developing the red, green and blue phosphor materials using a desired screen mask, so that the red, green and blue phosphor materials are coated on a corresponding discharge cell at the height of the barrier ribs. Next, glass bids are sprayed for thereby partially removing the red, green and blue phosphor materials, so that the red, green and blue phosphor materials are coated on the surfaces of the lower dielectric layer 17 and the barrier ribs 13 in Step ST27. Next, the backplate coated with the phosphor materials is molded for thereby forming the red, green and blue phosphor materials in Step ST28.

In the conventional screen printing method or sand blast method, in the case that the height of the barrier rib 13 is 100~200 μm, it is possible to coat the phosphor material at the height of the entire barrier ribs.

However, in order to increase the discharge efficiency, the PDP using the high frequency discharge must have an enough distance between two electrodes which generate a high frequency discharge. Therefore, the height of the barrier ribs is generally 500~2000 μm. In the case that the height of the barrier rib is high, it is impossible to uniformly coat the phosphor material by the conventional screen printing method and sand blast method. Namely, since the barrier ribs having the coated phosphor materials is formed of a glass having a high friction coefficient or a glass-ceramic material, when printing the paste state phosphor material, the paste state phosphor material does not flow into a deep portion, so that an uniform coating is not implemented.

Therefore, if the thickness of the coated phosphor material layer is non-uniform, the reflection of the visual light outputted from every discharge cell is non-uniform for thereby causing a certain image distortion. In particular, it is difficult to uniformly coat the phosphor with respect to the high frequency PDP of a lattice structure formed of the discharge cells having a high height of the barrier rib in order to prevent any optical interference between discharge cells. In addition, it is difficult to accurately adjust the position of the screen mask for coating red, green and blue phosphor materials on a corresponding cell.

SUMMARY OF THE INVENTION

Accordingly, it is an object of the present invention to provide a PDP(Plasma Display Panel) capable of uniformly coating a phosphor material on a backplate having a plurality of barrier ribs irrespective of the shape and height.

It is another object of the present invention to provide a back glass fabrication method for a PDP capable of uniformly coating a phosphor material on a backplate having a plurality of barrier ribs irrespective of the shape and height.

It is another object of the present invention to provide a PDP capable of coating a lubricant thin film on a backplate having a plurality of barrier ribs irrespective of the shape and height and uniformly coating a phosphor material on a backplate having a coated lubricant thin film.

It is another object of the present invention to provide a PDP fabrication method capable of coating a lubricant thin film on a backplate having a plurality of barrier ribs irrespective of the shape and height and uniformly coating a phosphor material on a backplate having a coated lubricant thin film.

It is another object of the present invention to provide a PDP capable of uniformly coating a phosphor material on a backplate having a height higher than 500 μm and a plurality of barrier ribs irrespective of shape.

It is another object of the present invention to provide a backplate fabrication method for a PDP capable of uniformly coating a phosphor material on a backplate having a height higher than 500 μm and a plurality of barrier ribs irrespective of shape.

To achieve the above objects, there is provided a backplate of a Plasma Display Panel (PDP) which includes a lubricant thin film layer formed on a front surface of a backplate having a barrier rib, and a phosphor material layer formed on the lubricant thin film layer.

To achieve the above objects, there is provided a backplate fabrication method for a PDP which includes a step for coating a lubricant material on a substrate having a barrier rib and forming a lubricant thin film, and a step for coating a phosphor material on the lubricant thin film.

To achieve the above objects, there is provided a backplate fabrication method for a PDP which includes the steps of coating a photosensitive phosphor material on a front surface of a backplate having a barrier rid, spraying a compression gas so that the photosensitive phosphor material is uniformly coated on a bottom portion of the backplate in which the barrier ribs are formed, and light-exposing/developing and drying the regions which will be coated with the phosphor material.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The backplate of a Plasma Display Panel (PDP) according to the present invention includes a lubricant thin film layer formed on a front surface of a backplate having a plurality of barrier ribs, and a phosphor material layer coated on the surface of the lubricant thin film layer.

Figure 1:
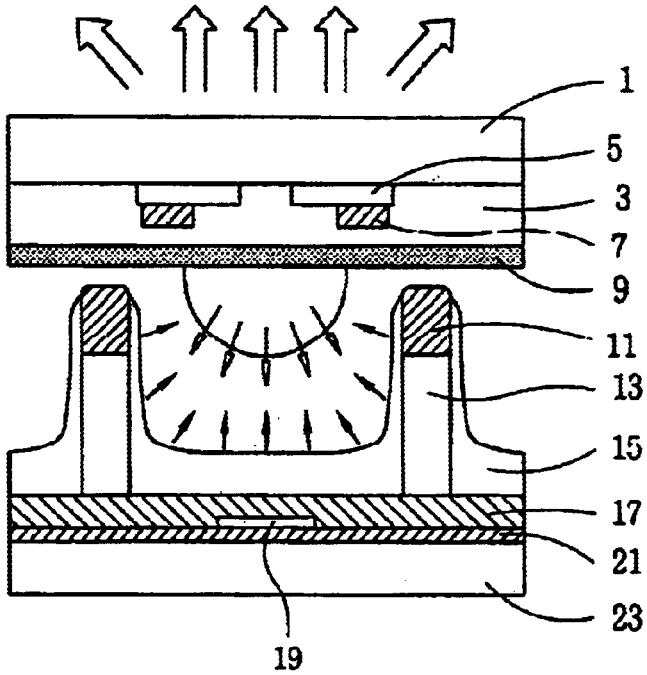
FIG.1 CONVENTIONAL ART
FIG. 1 is a view illustrating a structure of one cell in a conventional alternating plasma display panel (AC-PDP)
Figure 2:
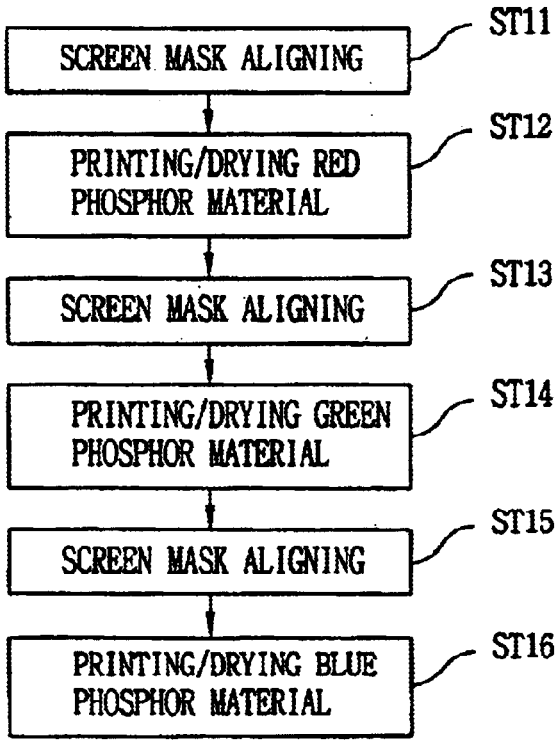
FIG.2 CONVENTIONAL ART
FIG. 2 is a flow chart illustrating a backplate fabrication method of a conventional PDP using a screen printing method.
Figure 3A:
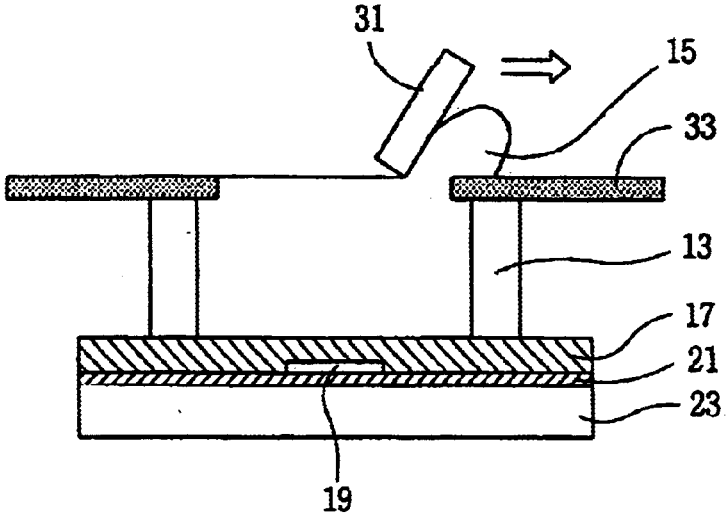
FIG.3A CONVENTIONAL ART
FIGS. 3A through 3C are cross-sectional views of a process for coating a phosphor material on a discharge cell of a conventional PDP using a screen printing method.
Figure 3B:
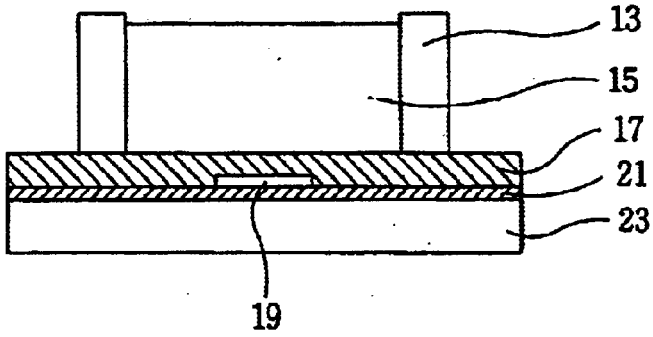
FIG.3B CONVENTIONAL ART
Figure 3C:
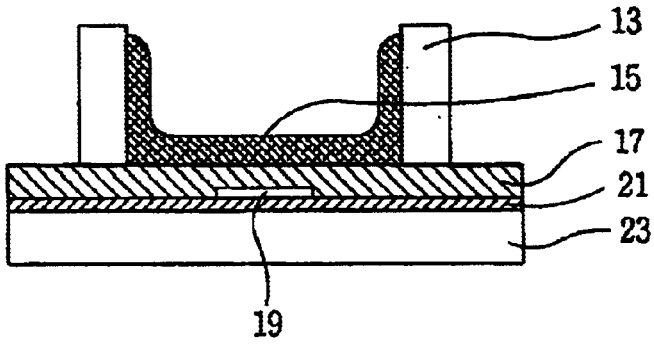
FIG.3C CONVENTIONAL ART
Figure 4:
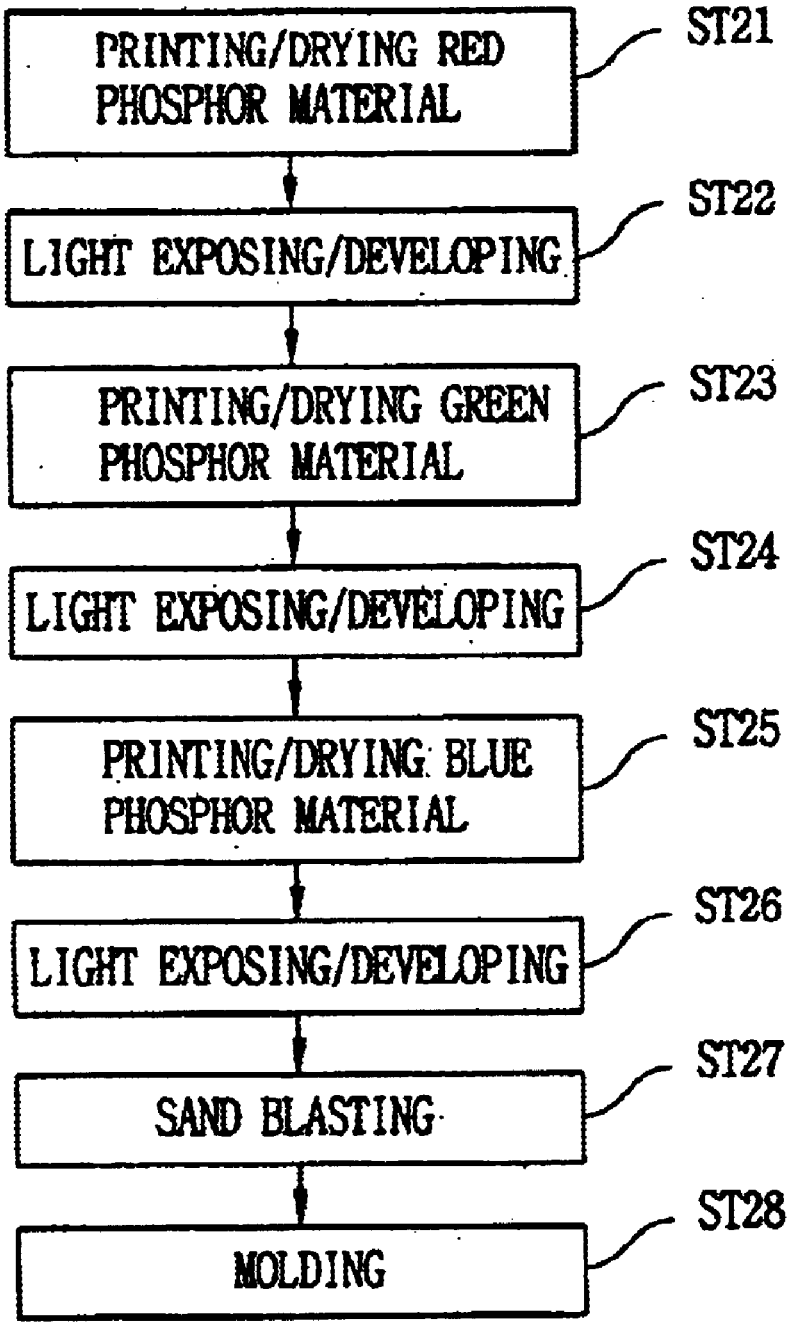
FIG.4 CONVENTIONAL ART
FIG. 4 is a flow chart of a backplate fabrication method for a conventional PDP using a sand blast method.
Figure 5:
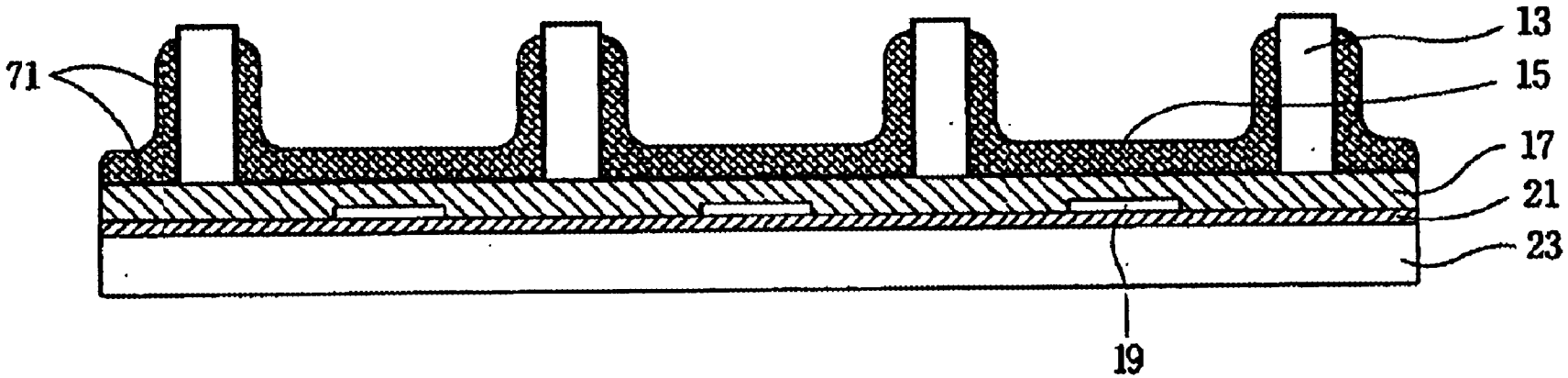
FIG. 5 is a cross-sectonal view illustrating a structure of a backplate of a PDP according to the present invention.

FIG. 5 illustrates a backplate structure of a PDP according to the present invention which includes a backplate 23, a under layer 21 sequentially stacked on the backplate 23, an address electrode 19, a lower dielectric layer 17 including the address electrode 19, a plurality of barrier ribs 13 formed on the lower dielectric layer 17, a lubricant thin film 71 coated on the lower dielectric layer 17 and the barrier ribs 13, and red, green and blue phosphor material layers 15 coated on the lubricant thin film 71.

In the backplate of the PDP according to the present invention, the lubricant thin film is formed on the surfaces of the backplate and the barrier ribs for uniformly coating the phosphor materials on the surfaces of the backplate and the barrier ribs. Therefore, the material of the lubricant thin film has a low friction coefficient. Namely, the material of the lubricant thin film has a relatively low friction coefficient lower than 0.06. For example, as the material of the same, there are DLN (Diamond-Like Nano-composite), DLC (Diamond-Like Carbon), $MoS_2$, Teflon™ (polytetrafluoroethylene, hereinafter referred to as "Teflon" generally), etc. In addition, the lubricant thin film is capable of uniformly coating the phosphor material and effectively reflecting a back scattering light reflected from the phosphor material layer. Therefore, the lubricant thin film has a refractive index higher than 2.2.

Here, the material-based friction coefficient and refractive index used to the lubricant thin film 71 may be expressed in the following table 1.

TABLE 1

| Lubricant thin film | DLN | DLC | $MoS_2$, | Teflon |
|---|---|---|---|---|
| Friction coefficient | 0.03 | 0.04 | 0.05 | 0.05 |
| Refractive index | 2.5 (max) | 2.2 | 2.4 | 2.3 |

As shown in Table 1, the materials used for the lubricant thin film has a friction coefficient of 0.03~0.05 and a refractive index higher than 2.0. Therefore, the materials used for the lubricant thin film according to the present invention have good lubricating characteristics compared to a soda lime glass having a friction coefficient of 0.08~0.09 and the materials of $SiO_2$ thin film or $Si_3N_4$ thin film having a friction coefficient of 0.12~0.14.

The lubricating thin film 71 having a small friction coefficient has a low resistance characteristic with respect to the flow of the phosphor material, so that the phosphor material is uniformly coated into a deep bottom of the discharge cell interior irrespective of the height of the barrier ribs and the shape of the same such as a stripe type or a lattice shape (for example, rectangular, square and circle, etc.).

The lubricant thin film 71 having a large refractive index reflects most of back light of the phosphor material 15 and prevents any interference due to the back light for thereby enhancing a light emitting efficiency of the visual ray. For example, as shown in the following Table 2, the DLN thin film has different refractive indexes based on the kinds of the added metal.

TABLE 2

| DLN thin film | W-DLN | Hf-DLN | Zr-DLN | Al-DLN | Nb-DLN |
|---|---|---|---|---|---|
| Refractive index | 2.2 | 2.5 | 2.4 | 2.2 | 2.5 |

The process for coating the lubricant thin film on the backplate having barrier ribs, electrode and lower dielectric layer and the method for coating the phosphor material on the lubricant thin film in accordance with a PDP backplate fabrication method using the lubricant thin film material according to the present invention will be explained.

Figure 6:
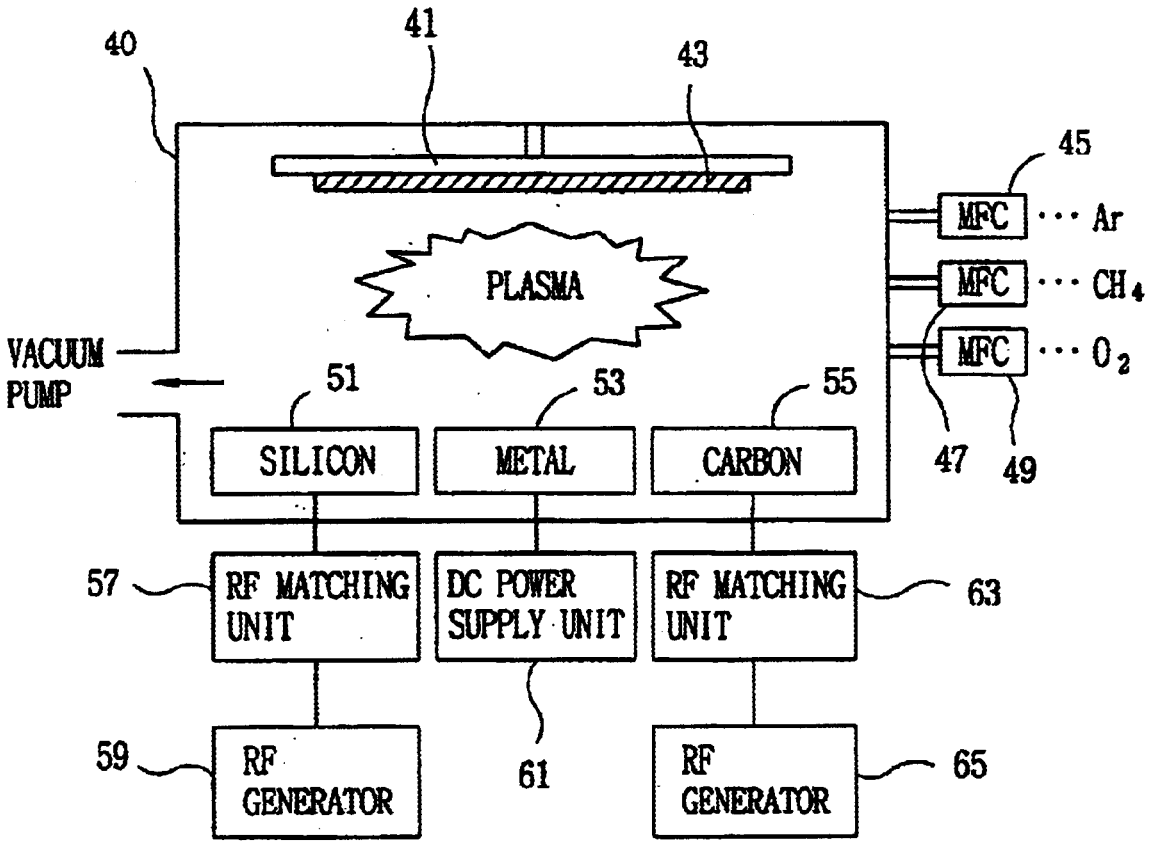
FIG. 6 is a view illustrating the construction of a high frequency cosputtering (RF-cosputtering) apparatus for forming a lubricant thin film on a backplate of a PDP according to the present invention.

FIG. 6 illustrates the construction of a high frequency-cosputtering (RF-cosputtering) for forming a lubricant thin film on the backplate of the PDP according to the present invention which includes a chamber 40, mass flow controllers 45, 47 and 49 for injecting gas into the chamber 40, a substrate holder 43 installed in the chamber, a silicon target 51, a metal target 53, a carbon target 55, high frequency generators 59 and 65 for generating a high frequency signal, and high frequency matching units 57 and 63 for matching to transfer the high frequency signals from the high frequency generators 59 and 65 to the targets.

The method for forming the lubricant thin film on the backplate based on the high frequency-cosputtering apparatus will be explained.

The backplate 43 having barrier ribs is fixed by the substrate holder 41, and the interior of the chamber 40 is made to a vacuum state of $10^{-7}$ Torr. Next, mixed gas of Ar, $CH_4$, $O_2$ is inserted into the chamber 40 through the first through third mass flow controllers 45, 47 and 49 under a pressure of 3~5 mTorr, 50 sccm based on a mixture ratio of 100:30:10. When the plasma is formed in a state that the gas is inserted, an acceleration ion of Ar gas collides with the silicon target 51 and the metal target 53 of W, Hf, Zr, Al, Nb, etc. and the carbon target 55 for thereby sputtering each element of the targets. The thusly sputtered elements react with a decompisition ion of $CH_4$ and $O_2$ inserted into the chamber, so that a DLN(Diamond-Like Nano-composite) thin film is formed on the front surface of the backplate 43.

At this time, a high frequency voltage is applied to the silicon target 51 and the carbon target 55 through the high frequency matching units 57 and 63 and the high frequency generators 59 and 65, and a DC(Direct Current) voltage is supplied to the metal target 53 through a DC power supply unit 61. Assuming that the sizes of the targets are 4 inches, the power is 150~300 Watt with respect to the silicon target 51, is 200~300 Watt with respect to the carbon target 55, and is 500~700 Watt with respect to the metal target 53.

The DLN thin film formed by the high frequency-cosputtering method under the above-described conditions has a structure in that a:C—H) network structure and a:Si—O) network structure formed about the metal ion and has a refractive index higher than 2.0 and a very low friction coefficient characteristic of about 0.03 in a few tens of Å in a non-coupled state.

Therefore, the DLN thin film has a low resistance characteristic with respect to the flow of the phosphor material, and it is possible to uniformly coat the phosphor material even when the height of the barrier rib is high.

The lubricant thin film 71 using the materials having the characteristics of Tables 1 and 2 is grown on a front surface of the lower portion having the barrier ribs 13 by a thickness of 1000 Å~10000 Å using the high frequency-cosputtering method (RF-cosputtering method), the evaporation method, the IBCD method (Ion-Cluster Bean Depositon method). In addition, a heat treatment may be performed at about 500° C. to remove a certain stress and an inert element contained in the lubricant thin film, and then the phosphor material 15 is coated.

Namely, the method for coating the phosphor material 15 is implemented using the screen printing method or sand blast method after the lubricant thin film layer is formed.

Figure 7:
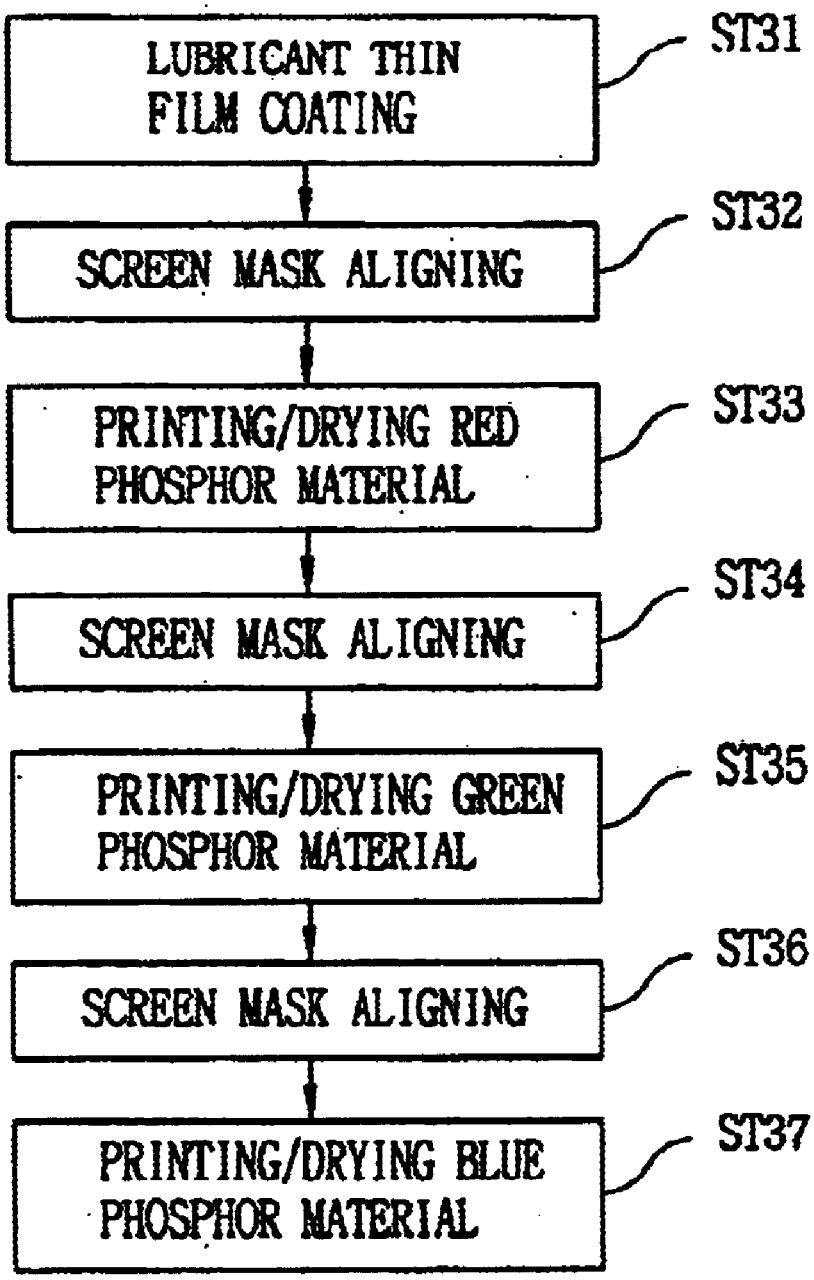
FIG. 7 is a flow chart of a fabrication method of a PDP backplate using a screen printing method according to the present invention.

FIG. 7 is a flow chart of a fabrication method of a PDP backplate using the screen printing method according to the present invention which includes a step ST31 for coating a lubricant thin film on a front surface of the backplate having the barrier ribs, steps ST32, ST34 and ST36 for positioning the screen mask at a certain position for coating the phosphor material, and steps ST33, ST35 and ST36 for sequentially printing and drying the red, green and blue phosphor materials. The phosphor material coating steps will be explained with reference to FIGS. 8A through 8D.

Figure 8A:
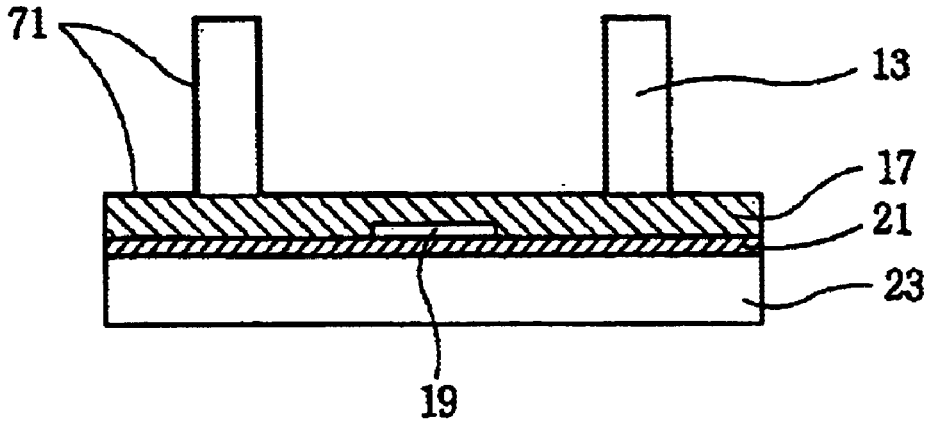
FIGS. 8A through 8D are cross-sectional views of a PDP backplate based on a sequence of a PDP back substrate fabrication method using a screen printing method according to the present invention.
Figure 8B:
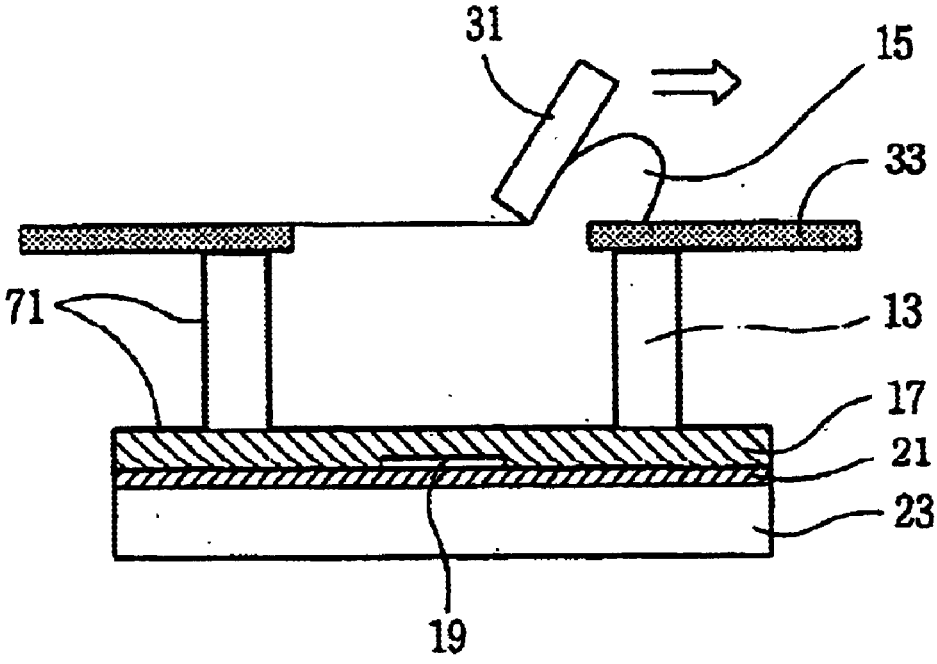

As shown in FIG. 8A, in a state that the address electrode 19, the under layer 21 the lower dielectric layer 17 and the barrier ribs 14 are sequentially stacked on the backplate 23, the lubricant thin film 71 is coated thereon. Next, as shown in FIG. 8B, the screen mask 33 is prepared on the backplate having the coated lubricant thin film 71, and paste stare red, green and blue phosphor materials 15 are printed on the backplate having the screen mask 33 thereon using a squeeze 31 in which a certain pressure is applied after the screen mask 33 is positioned on the backplate, having the coated lubricant thin film 71. At this time, in the paste state phosphor material 15, since the lubricant thin film 71 has a low resistance characteristic, the phosphor is coated even at a deep portion of the barrier rib 13.

Figure 8C:
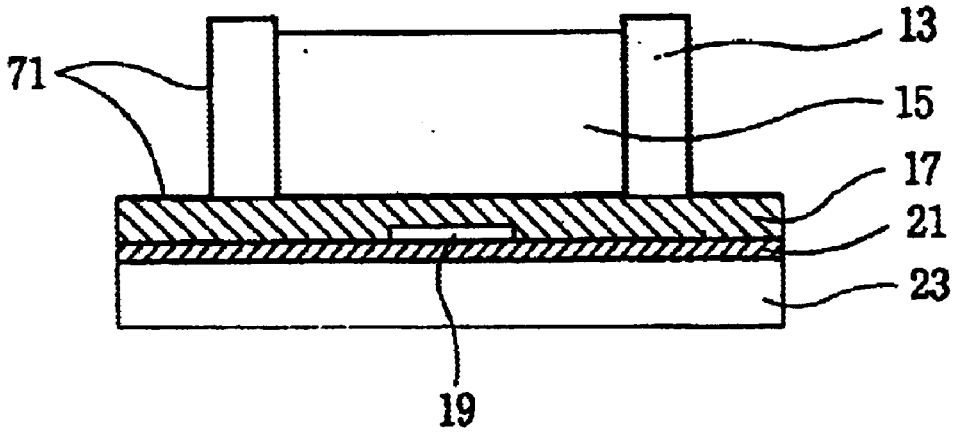
Figure 8D:
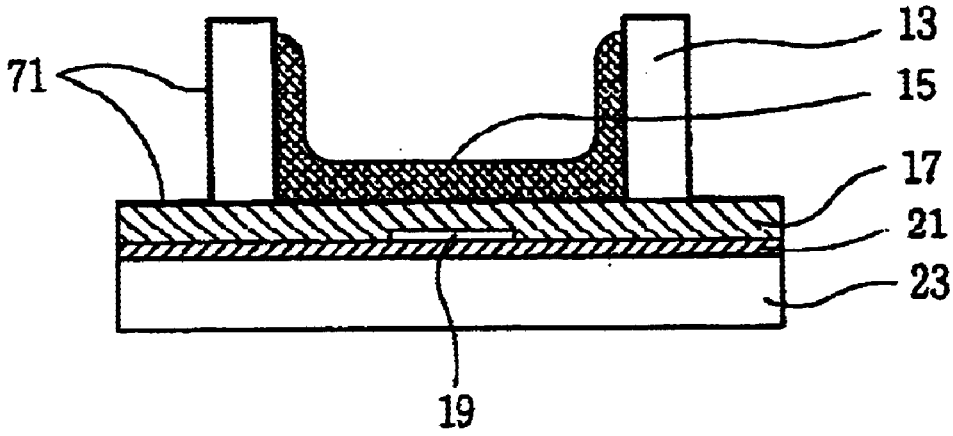

As shown in FIG. 8C, when the screen mask 33 is removed from the discharge cell filled with the paste state phosphor material 15, it is possible to obtain a state that the discharge cell is coated at a certain height similar to the height of the barrier rib 13. Next, when the paste state phosphor material 15 is dried, the organic solvent contained in the paste state phosphor material is evaporated. Therefore, as shown in FIG. 8D, the volume is decreased, and the phosphor material layer 15 uniformly coated on the surface of the lubricant thin film 71 is obtained.

Figure 9:
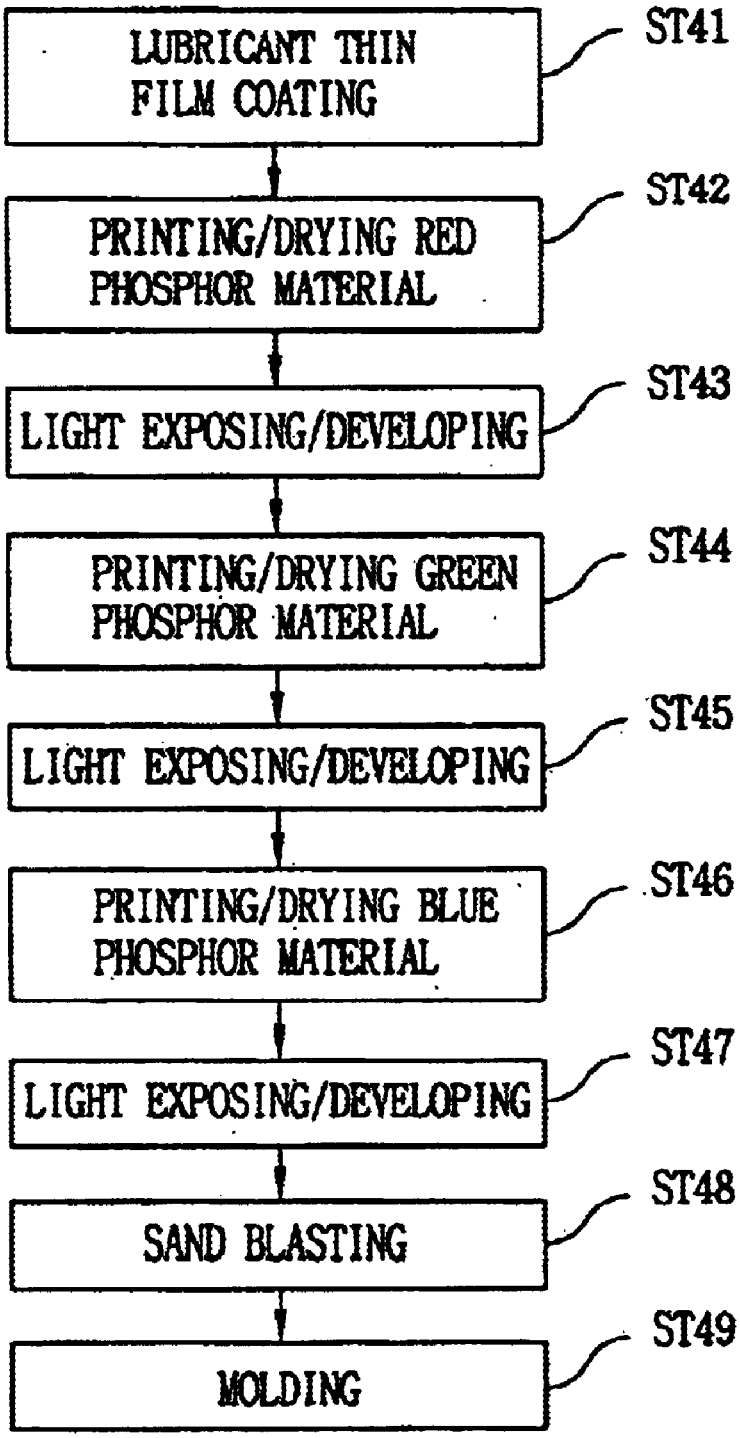
FIG. 9 is a flow chart of a PDP backplate fabrication method using a sand blast method according to the present invention.

FIG. 9 is a flow chart of a PDP backplate fabrication method using the sand blast according to the present invention.

As shown therein, in a step ST41, a lubricant tin film is coated on the front surface of the backplate having the barrier ribs, and in steps ST42, ST44 and ST46, red, green and blue phosphor materials coated on the front surface of the backplate having the coated lubricant thin film are printed and then dried. Each phosphor material is light-exposed using the screen mask and developed, so that a certain phosphor material is coated at a corresponding region at the height of the barrier rib in steps ST43, ST45 and ST47.

When the phosphor materials are coated at the height of the barrier rib, the phosphor material is partially removed using the sand blast method, so that the phosphor material is uniformly coated at a certain height on the surface of the lubricant thin film, and then the backplate having the coated phosphor material is molded, so that it is possible to uniformly coat the phosphor material on the backplate.

In the above-described method, for example, the lubricant thin film may be coated with respect to the backplate having the barrier ribs each having a certain height (for example, 500 μm), and then the phosphor material may be coated thereon. If the height of the barrier rib is 1000~2000 μm it is difficult to uniformly coat the phosphor material.

Therefore, in the present invention, it is possible to uniformly coat the phosphor material with respect to the backplate having the high height. The above-described operation will be explained in detail.

Figure 10:
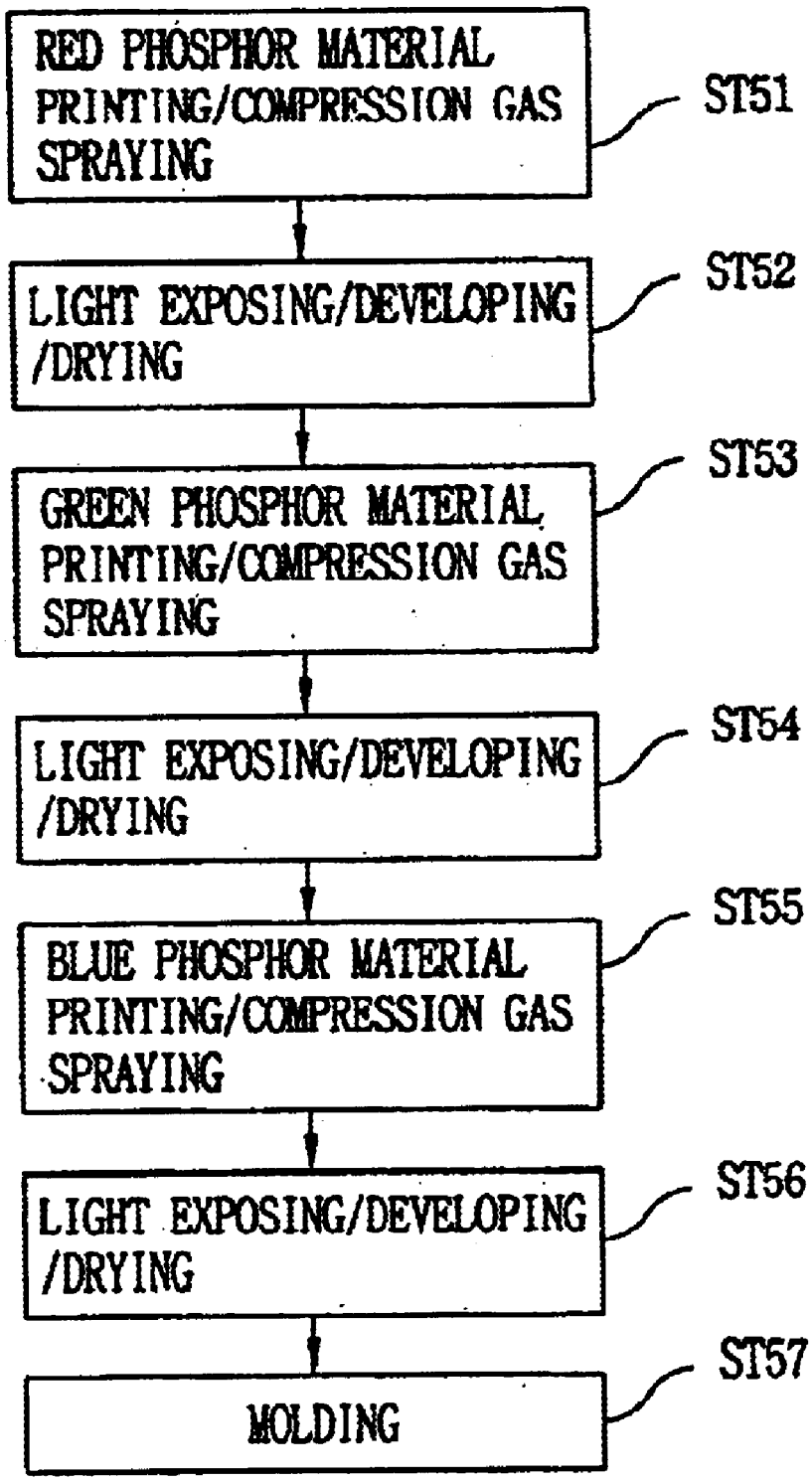
FIG. 10 is a flow chart of a PDP backplate fabrication method having a plurality of high barrier ribs according to the present invention.

FIG. 10 is a flow chart of a PDP backplate fabrication method having a high barrier rib which includes a step ST51 in which a red phosphor material is coated on the entire surface of the backplate of the PDP having a relatively high height without using the screen mask, and then the compressed gas is sprayed so is that the coated film of the phosphor material formed on the discharge cell is punctured by the pressure of the gas. Thereafter, when the phosphor material is uniformly coated on the surface of the barrier ribs, and the mask is positioned, and the discharge cells coated with the red phosphor material are exposed to a ultraviolet ray and developed, so that the red phosphor material is removed with respect to the remaining portions resulting remaining the light-exposed red phosphor material.

The process for coating the red phosphor material on the discharge cells is performed with respect to the green and blue phosphor material in the same manner, and the red, green and blue phosphor material layers are uniformly formed several times. The red phosphor material coating method will be explained in detail with reference to FIG. 11.

FIGS. 11A through 11D are cross-sectional views illustrating the phosphor material formation method of a fifth embodiment according to the present invention.

Figure 11A:
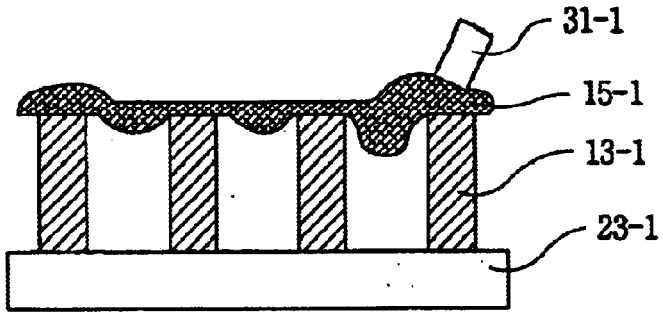
FIGS. 11A through 11D are cross-sectional views of a backplate based on a sequence of a PDP backplate fabrication method having a plurality of high barrier ribs according to the present invention.

As shown in FIG. 11A, the red phosphor material is coated on the entire portion of the backplate 23-1 having the barrier rib 13-1. The photosensitive phosphor material 15-1 having a density of about 40000 cps is flown over the backplate 23-1 having the barrier rib 13-1 without using the screen, and then the phosphor material is coated on the entire portion of the front surface using the squeeze 31-1 based on a certain pressure. The squeeze 31-1 is slanted at an angle of over 60° with respect to the backplate 23-1, and the scan speed of the same is set to 20 cm/min, and the phosphor material is scanned one or two times for thereby uniformly coating the phosphor material on the backplate.

In the case that the height of the barrier rib 13-1 is over 500 μm, even when the phosphor material 15-1 is coated all over discharge cells, the phosphor does not reach the deep portion of the barrier ribs 31-1. Even if the phosphor material 15-1 is heated over 100° C., the possibility that the phosphor material 15-1 of the discharge cell is punctured is about 40%. Therefore, the flow of the phosphor material 15-1 flown into the deepest portion of the barrier rib is only 30% with respect to the entire percentages.

Figure 11B:
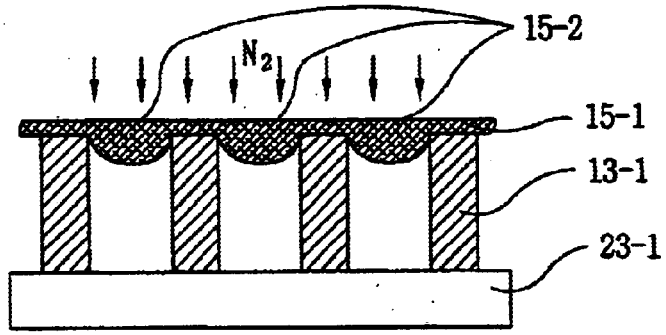

In order to overcome the above-described problem, as shown in FIG. 11B, the compression gas such as nitrogen is sprayed onto the phosphor material which covers the discharge cells, so that the phosphor material is uniformly coated on the surface of the barrier surface 13-1. At this time, the nitrogen gas is sprayed onto the phosphor material coated film based on a spraying pressure of 2 kg/cm$^2$. Therefore, the phosphor material coated film 15-2 which covers each discharge cell is punctured, so that the phosphor material 15-2 is flown to the lower portion along the surface of the barrier rib 13-1 based on the pressure of the gas. At this time, the possibility that the phosphor material coated film 15-2 formed on the discharge cells is 100%. In particular, more than 95% of the phosphor material is uniformly flown to the lowest portion of the barrier ribs by the compression gas. Thereafter, the backplate uniformly coated with the phosphor material formed on the surfaces of the barrier rib is dried for 20 minutes at about 120° C.

Figure 11C:
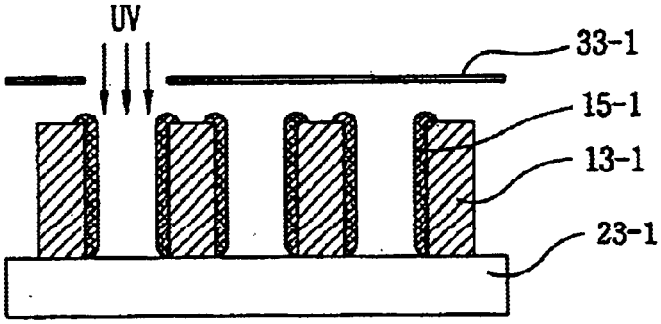
Figure 11D:
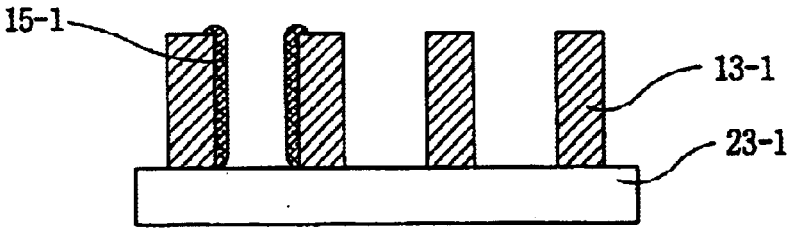

FIG. 11C is a cross-sectional view of a backplate in which the discharge cells which will be coated with the red phosphor material by positioning the mask on the dried backplate is exposed to an ultraviolet ray, and the remaining portions are not exposed to the ultraviolet ray by the mask. The backplate exposed to the ultraviolet ray is rinsed for about one minute using a D.I. water based on a pressure of 2 k/cm$^2$. Therefore, as shown in FIG. 11D, the phosphor material of the exposed portions remains, and the phosphor material of the remaining portions are all removed. The above-described process is performed with respect to the green and blue phosphor material in the same manner for thereby removing the phosphor material.

Therefore, in the phosphor material coating method according to the present invention, it is possible to uniformly coat the phosphor material layer on the discharge cells having higher than 500 $\mu$m of the barrier rib using an inert gas like nitrogen together with the front surface thin film coat.

In the case that the phosphor material is formed in the method using the compression spraying operation, it is possible to uniformly coat the phosphor material on the backplate having a high height of barrier rib without using the, lubricant thin film.

Therefore, in the case of forming the phosphor material in the method which uses the compression spraying operation, it is possible to uniformly coat the phosphor material on the substrate having a high barrier rib without using the lubricant thin film layer.

Figure 12:
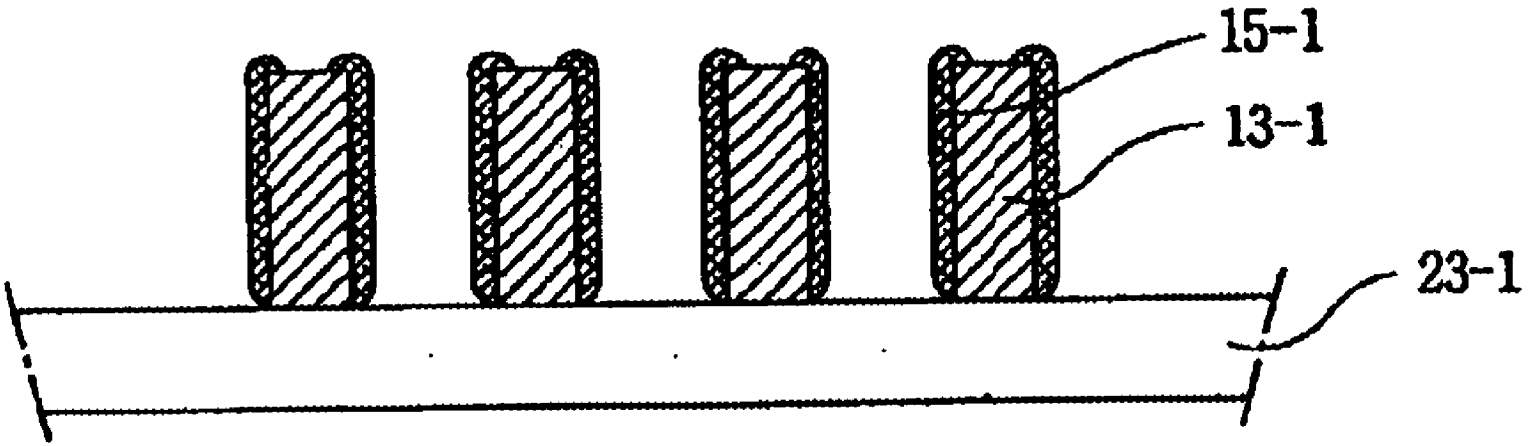
FIG. 12 is a cross-sectional view illustrating a backplate of a PDP fabricated in accordance with a fabrication method of a PDP backplate having a plurality of high barrier ribs according to the present invention.

FIG. 12 is a cross-sectional view of a backplate of a PDP fabricated in accordance with a fabrication method of a PDP backplate having a high barrier rib.

Therefore, the method for coating the phosphor material using the compression spraying operation, it is possible to form the phosphor material on the substrate formed with the barrier ribs having more than 500 $\mu$m height.

As described above, in the phosphor material coating method of a PDP according to the present invention, it is possible to coat the phosphor material at a uniform thickness by coating the lubricant thin film having a small friction coefficient before the phosphor material is coated on the backplate in the case that the height of the barrier rib is below 500 $\mu$m. In addition, it is possible to prevent the light interference based on the backward light by reflecting the backward light of the phosphor material using a lubricant thin film having a high refractive index and enhance the light emitting efficiency.

In addition, when the case that the height of the barrier rib is above 500 $\mu$m, in the method for uniformly coating the phosphor material on the backplate, the phosphor material is coated on the front surface of the backplate without using the screen mask, and the compression gas is sprayed onto the surface of the phosphor material which covers the backplate, so that it is possible to uniformly coat the phosphor material to a deep portion of the barrier rib.

Therefore, in the method for coating the PDP phosphor material according to the present invention, it is possible to uniformly coat the phosphor material at a certain thickness irrespective of the shape and height of the barrier rib, so that the images are not distorted due to the difference in the amount of the visual light.

As the present invention may be embodied in several forms without departing from the spirit or essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A backplate of a Plasma Display Panel (PDP), comprising:

a lubricant thin film layer formed on a front surface of the backplate having barrier ribs; and a phosphor material layer formed on the lubricant thin film layer, wherein a material of the lubricant thin film has a friction coefficient of below 0.06.

2. The backplate of claim 1, wherein a material of said lubricant thin film is selected at least one from the group consisting of: diamond-like Nanofilm composites, diamond-like Carbons, $MoS_2$, and polytetrafluoroethylene.

3. The backplate of claim 1, wherein said diamond-like Nanofilm composites comprise one or more of W, Hf, Zr, Al, or Nb.

4. The backplate of claim 1, wherein a material of a lubricant material has a refractive index above 2.0.

5. The backplate of claim 1, wherein the lubricant thin film layer is formed on the backplate having barrier ribs to uniformly coat a phosphor material on the backplate irrespective of the shape and height of the barrier ribs.

6. The backplate of claim 1, wherein a material of said lubricant thin film is selected at least one from the group consisting of: diamond-like Nanofilm composites (DLNs), diamond-like Carbons (DLCs) and $MoS_2$.

7. A backplate of a Plasma Display Panel (PDP), comprising:

a lubricant thin film layer formed on the backplate having barrier ribs to uniformly coat a phosphor material on the backplate irrespective of the shape and height of the barrier ribs; and a phosphor material layer formed on the lubricant thin film layer, wherein a material of said lubricant thin film is selected at least one from the group consisting of: diamond-like Nanofilm composites (DLNs), diamond-like Carbons (DLCs) and $MoS_2$.

8. A Plasma Display Panel (PDP), comprising:

a front plate;

a back plate spaced across from the front plate;

barrier ribs formed on the back plate facing the front plate;

a lubricant thin film layer formed on a surface of both the back plate and the barrier ribs; and a phosphor material layer formed on the barrier ribs, wherein a material of said lubricant thin film is selected at least one from the group consisting of: diamond-like Nanofilm composites (DLNs), diamond-like Carbons (DLCs), $MoS_2$ and polytetrafluoroethylene.

9. The PDP of claim 8, wherein the lubricant thin film comprises diamond-like Nanofilm composites, wherein said diamond-like Nanofilm composites comprise one or more of W, Hf, Zr, Al, or Nb.

10. The PDP of claim 8, wherein the lubricant thin film comprises diamond-like Carbons.

11. The PDP of claim 8, wherein the lubricant thin film comprises $MoS_2$.

12. The PDP of claim 8, wherein the lubricant thin film forms a continuous film over both the back plate and the barrier ribs.

13. The PDP of claim 8, wherein the surface of both the back plate and the barrier ribs where the lubricant thin film is formed comprises side surfaces of the barrier ribs.

14. The PDP of claim 8, wherein the surface of both the back plate and the barrier ribs where the lubricant thin film is formed comprises upper surfaces of both the back plate, where the barrier ribs are not located, and the barrier ribs and side surfaces of the barrier ribs.

15. The PDP of claim 8, wherein the lubricant thin film uniformly coats the back plate and the barrier ribs.

16. The PDP of claim 8, wherein the phosphor material uniformly coats the back plate and the barrier ribs on the back plate irrespective of the shape and height of the barrier ribs.

17. The PDP of claim 8, wherein the phosphor material flows along the lubricant thin film coating the back plate and the barrier ribs on the back plate with phosphor material irrespective of the shape and height of the barrier ribs.

* * * * *